US011547892B2

(12) United States Patent
Isler

(10) Patent No.: US 11,547,892 B2
(45) Date of Patent: Jan. 10, 2023

(54) WEIGHT TRAINING EQUIPMENT

(71) Applicant: Coy Donald Isler, Goldsboro, NC (US)

(72) Inventor: Coy Donald Isler, Goldsboro, NC (US)

( * ) Notice: Subject to any disclaimer, the term of this patent is extended or adjusted under 35 U.S.C. 154(b) by 47 days.

(21) Appl. No.: 17/333,477

(22) Filed: May 28, 2021

(65) Prior Publication Data

US 2022/0379156 A1 Dec. 1, 2022

(51) Int. Cl.

| | |
|---|---|
| ***A63B 21/06*** | (2006.01) |
| ***A63B 21/055*** | (2006.01) |
| ***A63B 21/00*** | (2006.01) |
| ***A63B 21/04*** | (2006.01) |
| ***A63B 21/072*** | (2006.01) |

(52) U.S. Cl.

CPC ..... *A63B 21/0615* (2013.01); *A63B 21/0428* (2013.01); *A63B 21/0552* (2013.01); *A63B 21/0724* (2013.01); *A63B 21/4035* (2015.10)

(58) Field of Classification Search

CPC ..... A63B 21/0428; A63B 21/0552; A63B 21/0615; A63B 21/0724; A63B 21/4035

See application file for complete search history.

(56) References Cited

U.S. PATENT DOCUMENTS

| | | | | |
|---|---|---|---|---|
| 8,360,938 | B2 * | 1/2013 | Gilman | A63B 69/34 482/93 |
| 10,022,580 | B2 * | 7/2018 | Tyree | A63B 21/0616 |
| 10,525,299 | B1 * | 1/2020 | Leath | A63B 21/0004 |
| 10,881,892 | B2 * | 1/2021 | McCall | A63B 21/0615 |
| 11,040,233 | B2 * | 6/2021 | Sands | A63B 21/0724 |
| 11,161,005 | B1 * | 11/2021 | Farrow | A63B 21/4035 |
| 2005/0130814 | A1 | 6/2005 | Nitta et al. | |
| 2018/0126211 | A1 * | 5/2018 | Chen | A63B 21/075 |
| 2019/0134451 | A1 * | 5/2019 | McCall | A63B 21/4035 |
| 2020/0023225 | A1 * | 1/2020 | Sands | A63B 21/16 |
| 2020/0147439 | A1 * | 5/2020 | Acuna, Jr. | A63B 21/4035 |
| 2022/0249897 | A1 * | 8/2022 | Matthew Lamarque | A63B 21/0615 |

FOREIGN PATENT DOCUMENTS

WO 2017130112 A1 8/2017

* cited by examiner

*Primary Examiner* — Joshua Lee

(74) *Attorney, Agent, or Firm* — James G. Passe; Passe Intellectual Property, LLC

(57) ABSTRACT

A weight training platform designed to have the ability to use free weights and resistance bands simultaneously, which can increase muscle strength and endurance with repetitive movements and has the advantage of being inexpensive, space conscious, and portable.

12 Claims, 4 Drawing Sheets

WEIGHT TRAINING EQUIPMENT

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a weight training platform. In particular, it is a weight training platform designed to use free weights and resistance bands simultaneously.

Description of Related Art

The use of free weights and resistance bands is a staple of weight training exercise. Typically, there are various machines for various exercises that a free weight can be placed on for weight training. Resistance bands are typically wrapped around a fixed object and are especially attractive for travel. Repetitive movement with these increases muscle strength and endurance.

While resistance bands are relatively cheap as are a set of free weights, equipment to use with them is frequently very expensive and can take up large amounts of room. Accordingly, a gym membership, while expensive, is often cheaper than buying one's own equipment. Even further, multiple machines create a need for a lot of room. Accordingly, there is always a need to improve upon the use of space and equipment to find better ways of weight training.

BRIEF SUMMARY OF THE INVENTION

The present invention relates to the discovery of a platform design that accommodates both free weights and resistance bands on the same piece of equipment at the same time and allows a user to use both simultaneously. In one embodiment, it is built of materials that make it easily portable.

Accordingly, in one embodiment, there is a weight training platform comprising:

a) a base having a top, a bottom, a first end, and a second end;

b) a frame having a third and a fourth end, the third end pivotally attached to the top of the base at or near the first end of the base and having the fourth end positioned at or near the base second end;

c) wherein the fourth end has a first free weight crossbar and wherein there is a removable mini resistance band crossbar positioned near the fourth end;

d) a pair of feet designed to keep the second end positioned above the base; and e) one or more hooks or holes for attaching at least one resistance band.

DETAILED DESCRIPTION OF THE INVENTION

Figure 1:
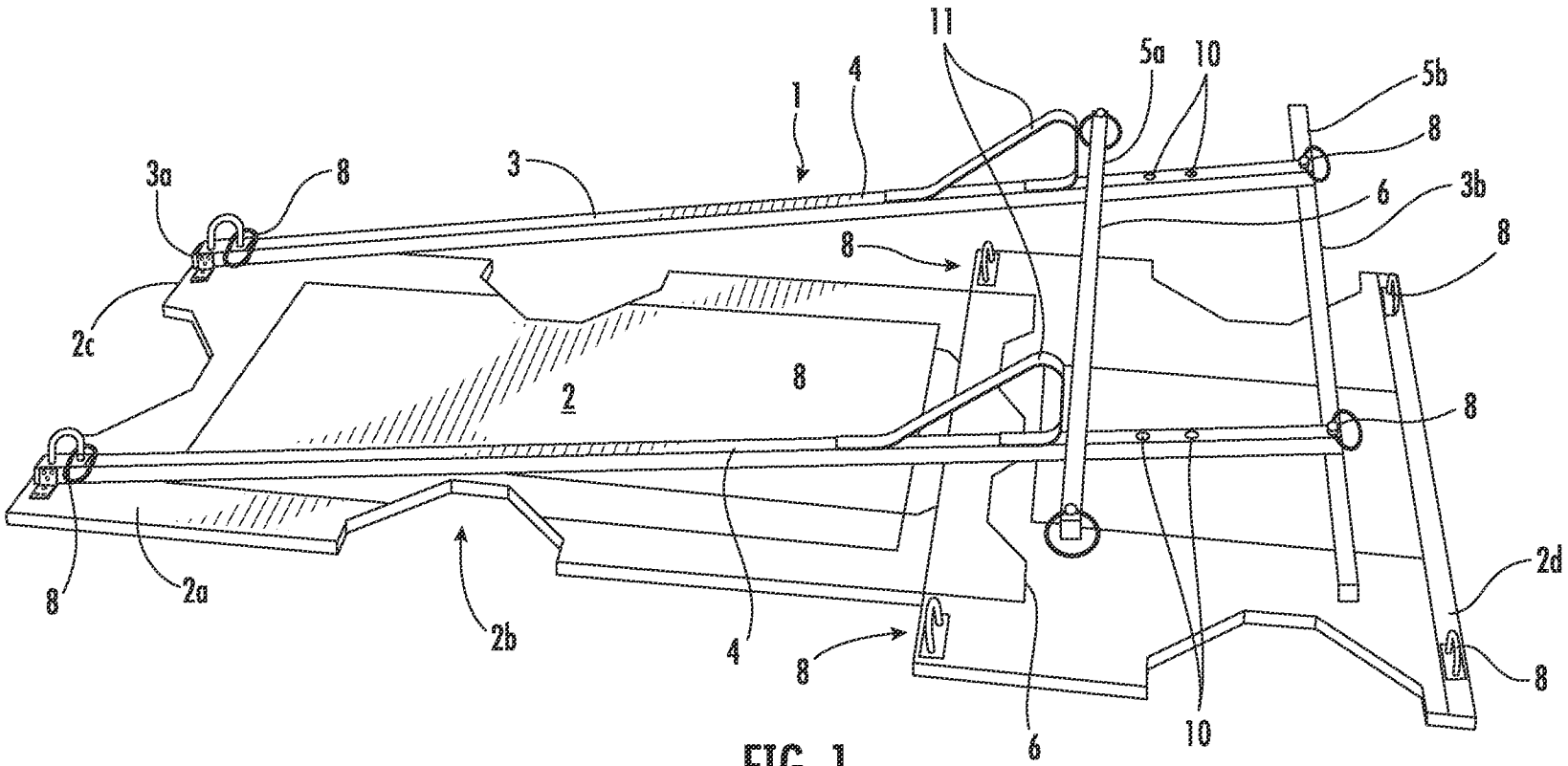
FIG. 1 is a side perspective view of the present invention.

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

Definitions

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

The drawings featured in the figures are for the purpose of illustrating certain convenient embodiments of the present invention and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein, and use of the term "means" is not intended to be limiting.

As used herein, the term "weight training platform" refers to a portable device which sits on the floor during use and is designed to allow a user to utilize free weights and resistance bands simultaneously in a weight training program.

As used herein, the term "base" refers to a flat board or other flat material which sits on a flat floor. It is sized to allow the user to stand on portions of the base while using the weight training platform and to allow attachment of a pivotal frame for attaching free weights and at least one end of a resistance band. The base has a top, a bottom, a first end, and a second end. One or more hooks or holes may be mounted on the base for attachment of one end of a resistance band. In one embodiment, the hooks are mounted on the first and second end. In one embodiment, there are one or more anti-slip materials on the top side of the base.

As used herein, the term "frame" refers to an essentially rectangular frame consisting of two square longitudinal frame members each having third and fourth ends with the third ends pivotally mounted at the first end of the base, such that the fourth ends of the frame can be elevated and lowered with the attached weights and resistance bands. The opposite sides of the square longitudinal frame members are at or near the second end of the base (as seen in the Figures for example). A crossbar between the two third ends is an optional feature. There is a first free weight crossbar at the fourth end of the frame positioned on the two square longitudinal frame members in a perpendicular manner and a removable mini resistance band crossbar offset from the first by about 9¾ inches, and wherein the distance between the two crossbars is optionally adjustable. The frame can also have optional handles and hooks at a desired location on the frame.

As used herein, the term "at or near" refers to at an end of the base or within up to 1, 2, 3, 4, or 5 feet away from an end of the base.

As used herein, the term "free weight crossbar" refers to a frame crossbar positioned perpendicular to the square longitudinal members with the square longitudinal members being parallel. It connects the two square longitudinal members, but also extends beyond that continuing on both sides until there is enough room to fit free weights on each end of the first free weight crossbar as exemplified in the Figures. One is positioned at the fourth end of the frame and at least a second one is positioned at or near the first free weight crossbar. The removable mini resistance band crossbar may be made positionally adjustable by making the crossbar removable with multiple sites that the crossbar could be installed at. These add to the stability of the equipment.

As used herein, the term "pair of feet" refers to feet positioned on the bottom of the frame in a position that elevates the second end of the frame above the base enough that the free weights will fit on the crossbar.

As used herein, the term "hooks" refers to fixed clips, rings, hooks, holes in the platform, and the like that one can attach an end of an resistance band to in an embodiment by positioning the hooks or holes near one of the crossbars. The resistance band can be attached to both the base and frame while weights are on the ends of the crossbar.

As used herein, the term "grip handle" refers to handles on the frame to enable the user to grab and to lift the end of the frame with or without weights or resistance bands attached.

As used herein, the term "one hand grip resistor" refers to a handle (FIG. 3) that attaches the ends of at least 2 resistance bands together.

As used herein, the term "wedge support" refers to a stabilization bar placed anywhere under the platform as desired.

DRAWINGS

Now referring to the drawings, FIG. 1 is a side view of the weight training platform 1. It consists of base 2 having a top 2*a*, a bottom 2*b*, a first end 2*c*, and a second end 2*d*. It also has frame 3 having a third end 3*a* and a fourth end 3*b*, the third end 3*a* is pivotally attached to the top 2*a* of the base 2 at or near the first end 2*c* of the base 2, and having the fourth end 3*b* positioned at or near the base second end 2*d*. In one embodiment, second end 2*d* is removable. The frame 3, in this view, consists of two parallel square longitudinal arms 4 pivotally attached to the base 2, wherein the fourth end 3*b* has a first free weight crossbar 5*a* at the fourth end 3*b*, and wherein there is a removable mini resistance band crossbar 5*b* positioned near the fourth end 3*b*. The removable mini resistance band crossbar 5*b* is positioned perpendicularly along the square longitudinal arms 4. Shown are mounting holes 10 for attaching the removable mini resistance band crossbar 5*b*. A pair of feet 6 is positioned underneath the parallel square longitudinal arms 4 near removable mini resistance band crossbar 5*b* to keep the second end 2*d* positioned above the base 2 to allow room for placement of free weights on crossbar 5*a*.

Additionally, there are one or more hooks or holes 8 for attaching at least one resistance band on first free weight crossbar 5*a* and removable mini resistance band crossbar 5*b*. There are also, optionally, one or more lift handles 11 positioned to aid in lifting the frame 3 during weight training.

Figure 2:
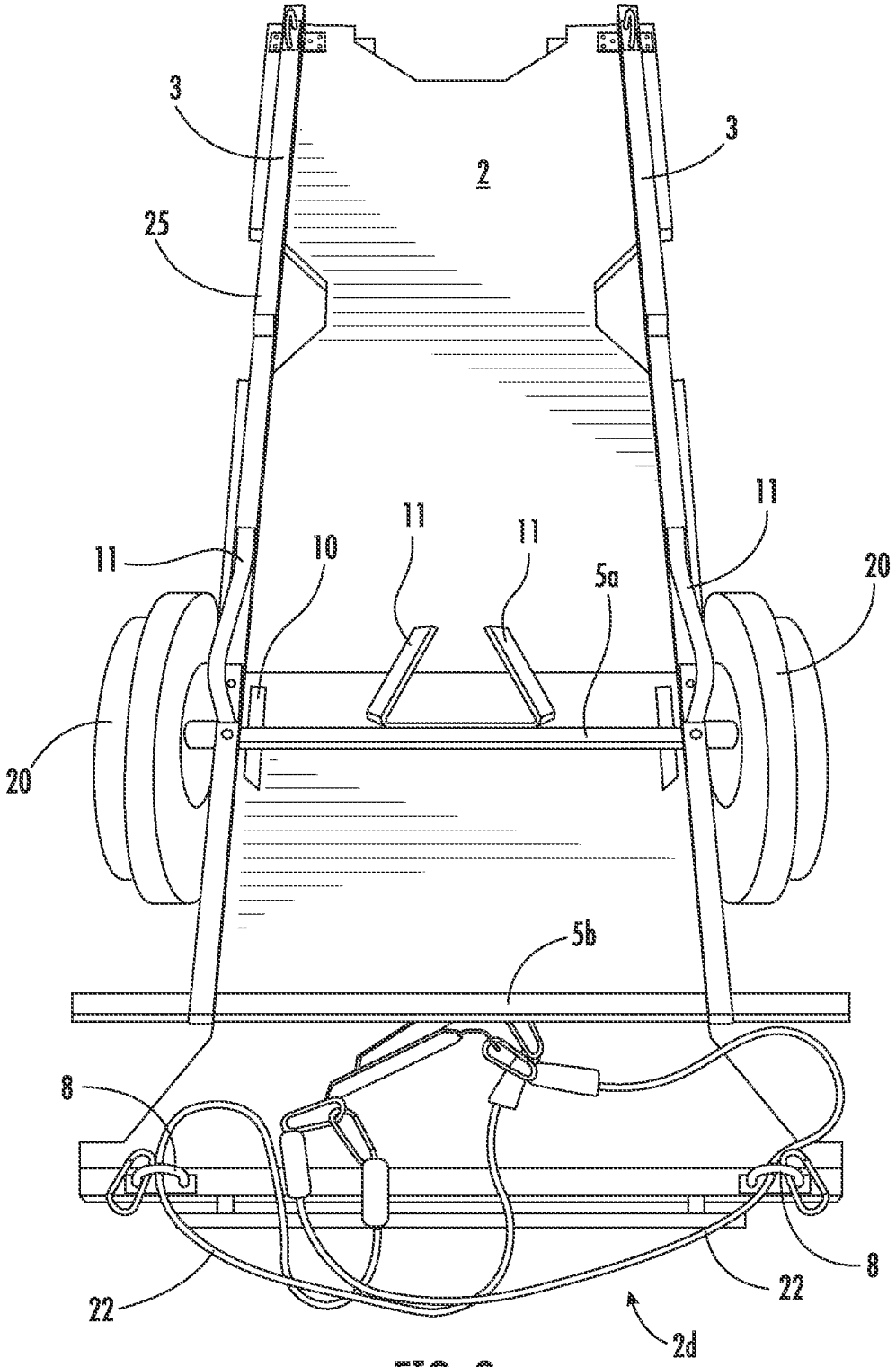
FIG. 2 is a top perspective view of the present invention.
Figure 3:
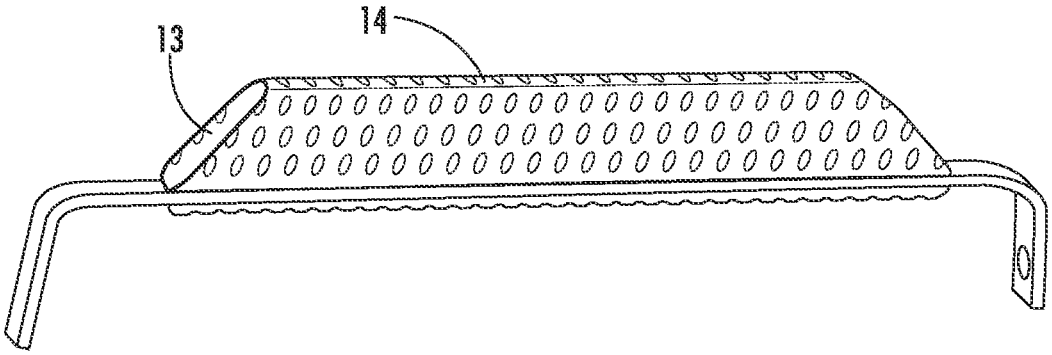
FIG. 3 is a side perspective view of a one hand grip resistor of the present invention.

FIG. 2 is a frontal view of an embodiment of the frame 3. In this view, weights 20 have been added to the first crossbar 5*a*. Weights 20 cannot be placed on the second crossbar 5*b*. Also shown are resistance bands 22 attached to hooks 8 at the base second end 2*d* and joined by the one grip hand resistor 13 (seen in FIG. 3) to allow use of two resistance bands at once. Lift handles 11 can also be seen in this view. Also shown is decorative tubing 25 mounted on the frame 3. FIG. 3 shows an enlarged view of the one grip hand resistor 13. It is noted in this embodiment that the one hand grip resistor 13 has a textured surface 14.

Figure 4:
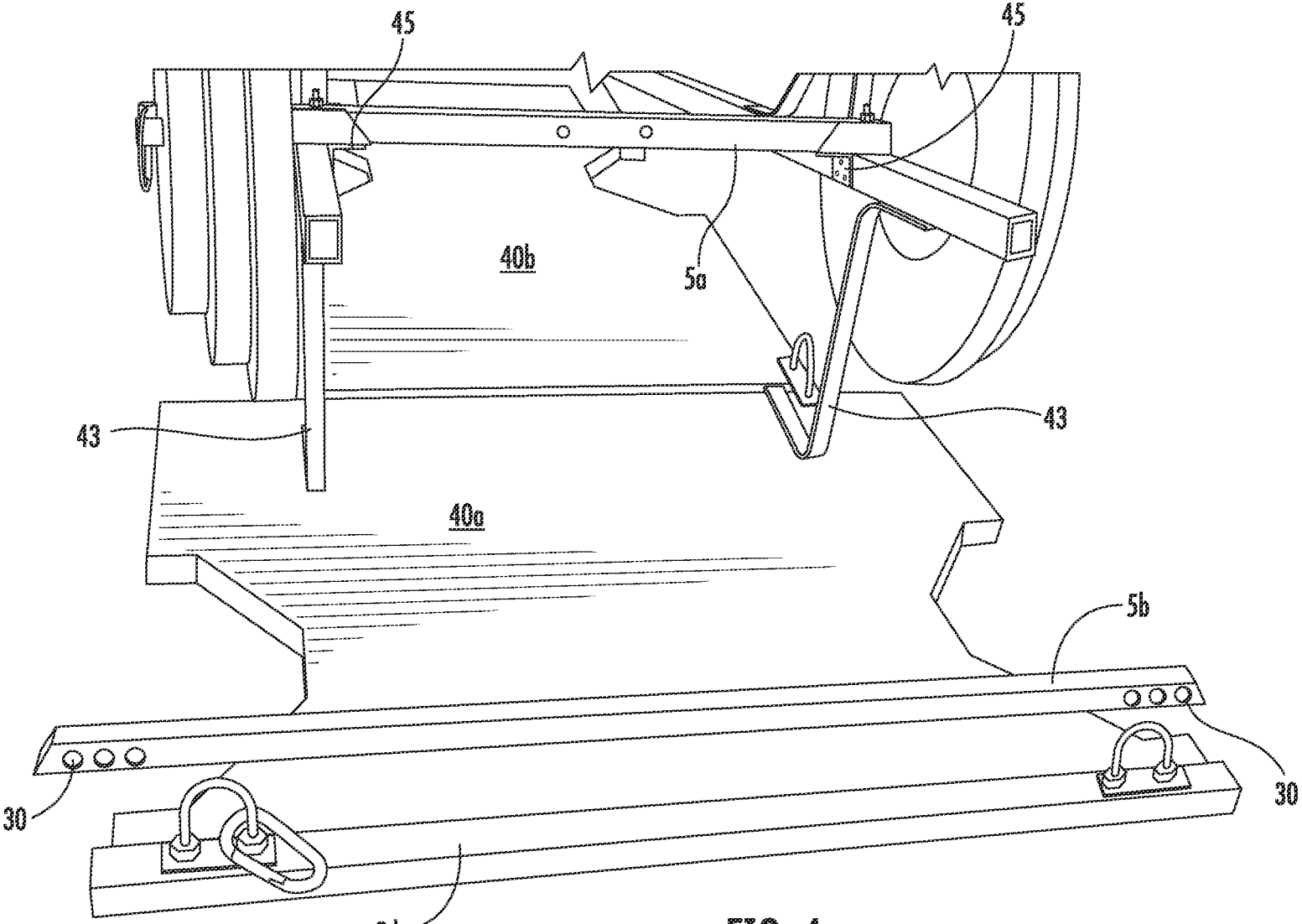
FIG. 4 is a perspective view of the present invention wherein the second end is removable.

FIG. 4 is a perspective view of the weight training platform 1, wherein second end 2*d* could be removed. Also in this embodiment, there can be a plurality of holes 30 designed to attach resistance bands. It is also shown as a 2-piece base 40*a* and 40*b*, though one or more pieces are contemplated. Lastly, feet 43 are positioned to elevate the weights on the crossbar 5*a* above the base of the device. In one embodiment, there are a plurality of braces 45 (L-Brace in FIG. 4) to add stability. Wedge supports can be added at any convenient location under the platform.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. A weight training platform comprising:

a) a base having a top, a bottom, a first end, and a second end;

b) a frame having a third and a fourth end, the third end pivotally attached to the top of the base at or near the first end of the base and the fourth end positioned at or near the base second end;

c) wherein the fourth end has a first free weight crossbar and wherein there is a removable mini resistance band crossbar positioned near the fourth end;

d) a pair of feet designed to keep the fourth end positioned above the base; and e) one or more hooks or holes for attaching at least one resistance band.

2. The weight training platform according to claim 1 wherein the removable mini resistance band crossbar is positionally adjustable on the frame.

3. The weight training platform according to claim 1 wherein there is at least one grip handle on the frame.

4. The weight training platform according to claim 1 wherein there are free weights on the first free weight crossbar.

5. The weight training platform according to claim 1 wherein there is a plurality of resistance bands connected to the one or more hooks.

6. The weight training platform according to claim 5 wherein there is a one hand grip resistor connecting at least two resistance bands.

7. The weight training platform according to claim 6 wherein the one hand grip resistor has a textured surface.

8. The weight training platform according to claim 1 wherein there is a plurality of resistance bands connected to to the one or more.

9. The weight training platform according to claim 1 wherein the frame has two square longitudinal bars, wherein the third end is attached to the base by a pivotal attachment.

10. The weight training platform according to claim 1 wherein there is at least one selected from the group consisting of rings, holes, and hooks on at least one of the base, the first free weight crossbar, the removable mini resistance band crossbar, and the frame third end.

11. The weight training platform according to claim 1 wherein the base is two pieces.

12. The weight training platform according to claim 1 wherein the weight training platform is portable.

* * * * *